United States Patent [19]

Tsunekawa et al.

[11] 4,303,290

[45] Dec. 1, 1981

[54] METHOD OF EVACUATING A FLUORESCENT LAMP BULB

[75] Inventors: Shinichi Tsunekawa; Makoto Hojo, both of Yokohama, Japan

[73] Assignee: Tokyo Shibaura Denki Kabushiki Kaisha, Kawasaki, Japan

[21] Appl. No.: 117,835

[22] Filed: Jan. 30, 1980

[30] Foreign Application Priority Data

Feb. 2, 1979 [JP] Japan ..... 54-11278

[51] Int. Cl.[3] ..... H01J 9/395

[52] U.S. Cl. ..... 316/20

[58] Field of Search ..... 316/20, 21, 24

[56] References Cited

U.S. PATENT DOCUMENTS

| | | | |
|---|---|---|---|
| 1,602,634 | 10/1926 | Anderson | 316/21 |
| 4,005,324 | 1/1977 | Delenga | 316/20 |
| 4,132,459 | 1/1979 | Lerner | 316/24 |

*Primary Examiner*—Joseph H. McGlynn

*Attorney, Agent, or Firm*—Cushman, Darby & Cushman

[57] ABSTRACT

A fluorescent lamp bulb is first decompressed to a pressure level higher than a prescribed final seal pressure, and a desired gas is introduced into the bulb and is expelled, while maintaining the intrabulb pressure at a level attained in the first decompression step. Then the intrabulb pressure is reduced from the maintained pressure level to the prescribed final seal pressure.

3 Claims, 3 Drawing Figures

METHOD OF EVACUATING A FLUORESCENT LAMP BULB

Figure 1:
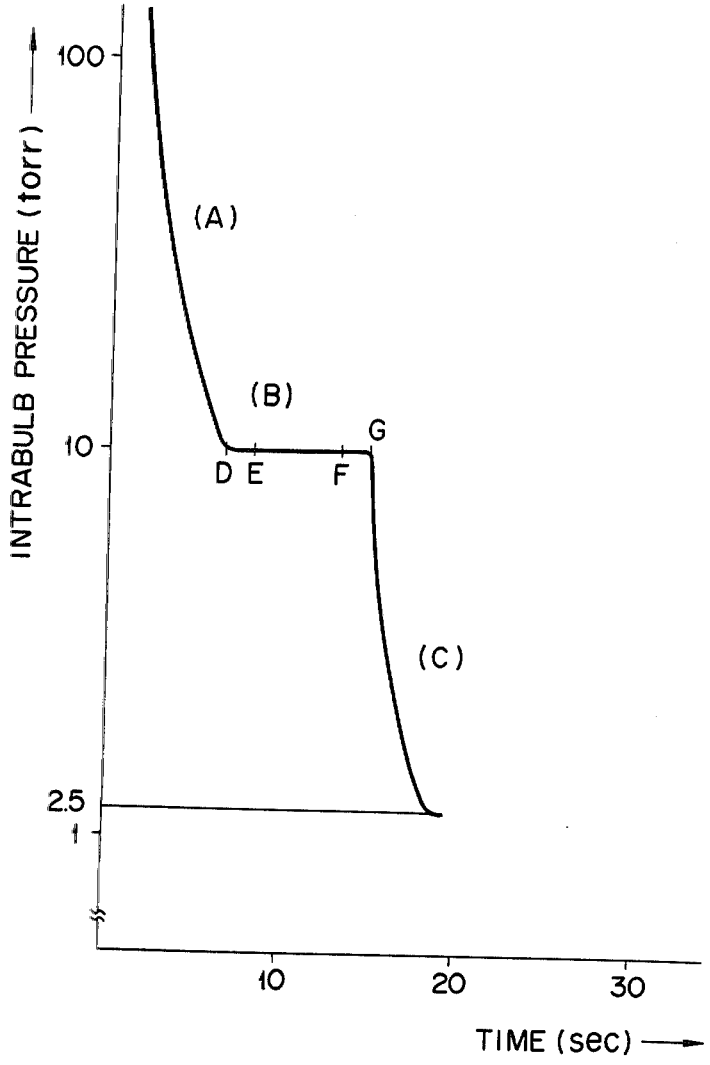

This invention relates to a method of evacuating a fluorescent lamp bulb during the manufacture of the lamp, and more particularly to a method of evacuating the lamp by utilizing the flow evacuation process.

The customary practice to manufacture a fluorescent lamp is to fit a stem to both ends of a bulb of the fluorescent lamp, evacuate the bulb, seal a desired inert gas of a prescribed pressure in the bulb, and cut off an evacuation tube by fusing its inner end opening. To date, various processes have been developed for the evacuation of the fluorescent lamp bulb. In recent years, however, the so-called flow evacuation process is utilized, which enables the evacuation of the fluorescent lamp bulb to be finished quickly.

The known flow evacuation process is to let a desired inert gas intermittently flow into a fluorescent lamp bulb. In this case, the bulb is first decompressed, until a certain high degree of vacuum is reached in the bulb, and then a desired inert gas is introduced into the bulb. After the bulb is decompressed to a lower pressure level than that attained during the initial decompression, the inert gas is again let to flow into the bulb. Thereafter, the bulb is decompressed to a pressure level lower than that which is attained during the second decompression and also the prescribed final seal pressure. Last the inert gas is carried into the bulb to increase the intrabulb pressure up to the prescribed final seal pressure (for example, 2.5 torr). The above-mentioned prior art flow evacuation process has the drawbacks that the intermittent introduction of a desired inert gas into a bulb of a 40-w fluorescent lamp having an inner diameter of, for example, 32 mm up to the prescribed final seal pressure not only consumes a relatively long time as about 40 seconds, but also involves complicated operation steps.

Therefore, a demand has been made to develop a method of evacuating a fluorescent lamp as quickly and easily as possible.

It is accordingly an object of this invention to provide a method of evacuating a fluorescent lamp quickly and easily.

To this end, the present invention provides a method of evacuating a fluorescent lamp bulb comprising:

a first decompression step of decompressing a fluorescent lamp bulb, on the inner wall of which a fluorescent layer is deposited, and both ends of which are provided with an electrode and connected to first and second evacuation tubes, to a pressure level higher than a prescribed final seal pressure through the first evacuation tube;

a flow step of, while maintaining the intrabulb pressure at the level attained in the first decompression step, introducing a desired gas into the bulb through the second evacuation tube and expelling the gas through the first evacuation tube to fill the bulb with said gas at said pressure level; and a second decompression step of decreasing the intrabulb pressure from the level attained in the first decompression step and maintained at the flow step to the prescribed final seal pressure.

Generally, a carbonate of an alkaline earth metal is previously deposited on the surface of the electrode disposed at both ends of a fluorescent lamp bulb. During the above-mentioned flow step, electric current is introduced through the electrodes to thermally decompose the carbonate of an alkaline earth metal into an oxide. A by-product ($CO_2$) of thermal decomposition released at this time is removed with the desired gas (flushing step).

Figure 2:
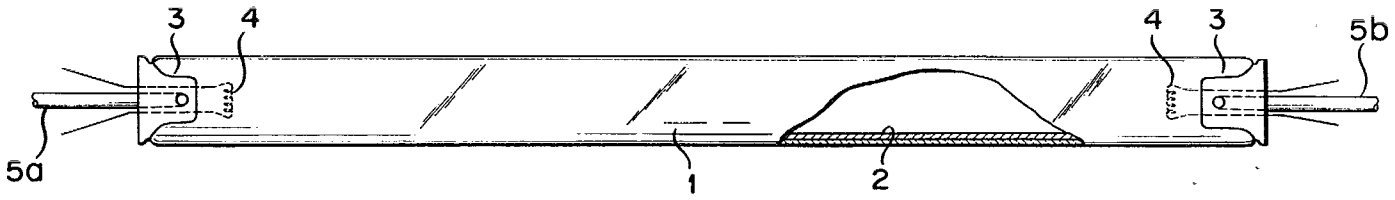
Figure 3:
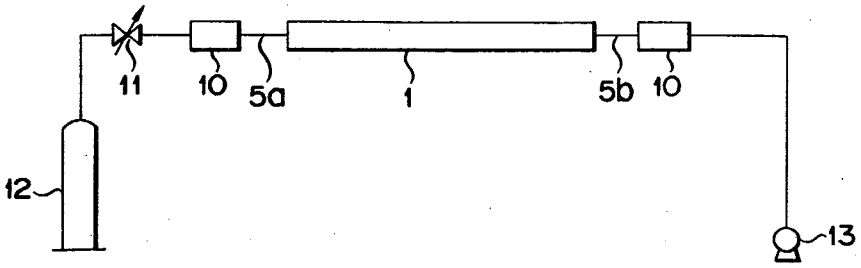

This invention can be more fully understood from the following detailed description when taken in conjunction with the accompanying drawings, in which:

FIG. 1 graphically shows the principle on which this invention is based;

FIG. 2 is a longitudinal view, partly in section, of a fluorescent lamp bulb to be evacuated by the method of the invention; and FIG. 3 is a block diagram showing an evacuation system applied in an evacuating method of the invention.

This invention will now be described in detail by reference to the accompanying drawings.

FIG. 1 indicates the decompression steps by way of illustrating the principle on which the evacuation method of this invention is based.

Referring to FIG. 1, character A denotes a first decompression step. During this step, a fluorescent lamp bulb is linearly decompressed down to the pressure level (for example, 1 to 10 torr) which is applied in the succeeding flow step B, that is, a pressure level higher than the prescribed final seal pressure. During the flow step B, a desired inert gas is taken into the fluorescent lamp bulb through an evacuation tube attached to one end of the bulb, and the gas is expelled through another evacuation tube fitted to the other end of the bulb to maintain the intrabulb pressure at a higher level (for example, 1 to 10 torr, usually 5 to 10 torr) than the prescribed final seal pressure. Thus during the flow step B, the atmospheric components remaining in the bulb is replaced by the desired gas.

Generally during this period, electric current is introduced through the electrodes provided at both ends of the bulb to thermally decompose the aforesaid carbonate of an alkaline earth metal deposited on the surface of the electrodes. At this time the so-called flushing step is taken to expel a released by-product of $CO_2$ with the desired gas.

The character C denotes a second decompression step of linearly decompressing the bulb after the completion of the flow step B down to the prescribed seal pressure (generally ranging between 0.5 and 5 torr, for example, 2.5 torr).

As apparent from the foregoing description, the desired gas is introduced only once into the bulb without repeating the cycle of the evacuation of the bulb and the introduction of the gas as has been practised in the prior art. Thereafter, the gas can be brought into the bulb with a prescribed final seal pressure simply by taking the second decompression step. Therefore, the method of the invention enables a fluorescent lamp bulb to be evacuated easily and quickly.

As the desired gas for use in the flow step it is possible to use argon, krypton, neon and the like gas alone or in combination. Further it is possible in accordance with this invention to seal a mixed gas in the bulb by initially flowing, for example, argon gas, followed by the substitution of the argon gas with a mixed gas of argon with krypton or neon at a later time during the flow step.

There will now be described by reference to FIGS. 2 and 3 a concrete example in which the evacuation method of this invention is practically applied.

Referring to FIG. 2, there is shown a fluorescent lamp bulb 1 which is to be evacuated by the method of this invention. A fluorescent layer 2 is deposited on the inner wall of the bulb 1. Reference numeral 3 denotes a stem hermetically fitted to both end openings of the bulb 1. The stem 3 is provided with an electrode 4, on the surface of which a layer of a carbonate of an alkaline earth metal is deposited. Both electrodes 4 are set in the bulb 1 to face each other. Reference numerals 5*a*, 5*b* denote evacuation tubes which cause the interior of the bulb to communicate with the atmosphere. After the evacuation of the bulb 1 is brought to an end, said evacuation tubes 5*a*, 5are cut off by fusing the openings of those end portions which are fitted to the bulb 1.

With a 40-w fluorescent lamp, for example, the bulb 1 has an outer diameter of 38 mm, and a total length of 1,198 mm (however, the effective internal space of the bulb 1 measures about 1,100 mm in length), while the evacuation tubes 5*a*, 5*b* have an inner diameter of 3.3 mm and a length of 90 mm.

With the bulb 1 constructed as described above, the evacuation tubes 5*a*, 5*b* are each hermetically set in place by means of a chuck 10, as shown in FIG. 3. One evacuation tube 5*a* is connected to a source 12 of a desired inert gas such as argon through a valve, for example, an electromagnetic valve which can vary the flow rate of the inert gas. The other evacuation tube 5*b* is connected to a vacuum pump 13. In the initial manufacturing stage, the bulb 1 is connected to the chucks 10 in a previously heated state or first fitted to the chucks and then heated. The heating is generally carried out at 150° C. or more, preferably at a temperature ranging between 300° and 450° C. Such high temperature heating is intended to expel impure gases absorbed to or occluded in the glass of the bulb 1. The heated bulb 1 supported by the chucks 10 is immediately decompressed by a vacuum pump 13, as shown at A in FIG. 1, linearly to point D at which the succeeding gas reaches a flow pressure. In the case of the 40-w fluorescent lamp as described above, a length of time required for the bulb 1 to be decompressed from the atmospheric pressure to the flow pressure, for example, 10 torr is generally about 5 seconds. This refers to the case where decompression (corresponding to A in FIG. 1) is carried out only through the evacuation tube 5*b*. However, said evacuation, if undertaken through both evacuation tubes 5*a*, 5*b* at the same time, consumes a shorter length of time, that is, about 3 seconds.

An electromagnetic valve 11 is then opened to conduct argon gas into the bulb 1 from the inert gas source 12 through the evacuation tube 5*a*. At this time, the bulb 1 is decompressed by the vacuum pump 13 through the other evacuation tube 5*b* to maintain the intrabulb pressure at a level of 10 torr. Thus, the argon gas carried into the bulb 1 replaces the atmosphere remaining in the bulb 1. As a result, the interior of the bulb 1 is cleaned by argon gas.

What is important in this connection is to replace the intrabulb atmosphere by high purity argon gas rapidly. The evacuation method of this invention dispenses with the operation of repeating the decompression of the bulb and the introduction of a gas as has been practised in the prior art method, and is characterized by replacing the intrabulb atmosphere by quickly introduced argon gas. With the intrabulb pressure at point D of FIG. 1 taken to be 10 torr, the method of this invention enables the argon gas to run through the bulb 1 at a flow rate of 15 l/sec or more. As a result, the partial pressure of the atmospheric components can be reduced to a level of 0.01 torr at point E in less than 2 seconds as counted from point D. Therefore, the operation of replacing the intrabulb atmospheric components by, for example, an inert gas of argon which extends from the step A to point E consumes as short a length of time as 7 seconds.

Even after the replacement of the intrabulb atmospheric components by the argon gas is brought to an end, the argon gas is still continued to flow through the bulb 1, and the intrabulb pressure is maintained at a level of substantially 10 torr. Under this condition, the carbonate of an alkaline earth metal deposited on the surface of the electrodes 4 provided at both ends of the bulb 1 is activated. In other words, when electric current is introduced through the electrodes 4, the carbonate is thermally decomposed in accordance with the following reaction formula:

$$RCO_3 \rightarrow RO + CO_2 \quad (1)$$

where R is an alkaline earth metal such as barium, calcium or strontium. For the quick and reliable progress of a chemical reaction from the left to the right term of the above reaction formula, it is necessary to speedily remove $CO_2$, namely, to decrease the partial pressure of $CO_2$. To this end, the replacement of unnecessary gases by, for example, a high purity inert argon gas is carried out, and also the so-called flushing step is taken while the high purity inert argon gas is continuously flowing. With the flow type evacuation process, a high purity inert gas such as argon wraps $CO_2$ gas and carries it away. Therefore, the partial pressure of the $CO_2$ gas in the proximity of the electrodes 4 is prominently reduced to accelerate the thermal decomposition expressed by the above reaction formula (1 ). Where the flow rate of, for example, the inert argon gas is set at 0.6 to 14 torr l/sec, then it has been ascertained that the thermal decomposition of a carbonate of an alkaline earth metal deposited on the surface of the electrodes of the bulb 1 is completed in about 5 seconds during the flushing step extending from point E to point F. During a period extending from point F to point G, the flushing step is taken for about 2 seconds to expel $CO_2$ gas supposedly remaining in the bulb 1.

Thereafter, the intrabulb pressure should advisably be reduced by a proper decompression device (not shown) to a prescribed seal level, for example, 2.5 torr for the sealing of an inert gas. Various types of decompression device are now available for use. For the object of this invention, however, it is preferred to apply the type, for example, a combination of an electromagnetic valve and vacuum pump, which can maintain a prescribed outlet pressure with high precision without being affected by an inlet pressure or a flow rate of a gas. This type of decompression device can reduce the intrabulb pressure linearly to a prescribed level for the sealing of an inert gas. As a result, the step C only consumes 5 or 6 seconds, thereby more accelerating the evacuation of a fluorescent lamp bulb than has been possible with the prior art method. In other words, the method of this invention completes the evacuation of a fluorescent lamp bulb in about 20 seconds, thereby decreasing the evacuation time by 20 seconds from that which has been required for the conventional method.

With the foregoing embodiment, the flow step B (FIG. 1) was taken at a pressure of 10 torr. Where, however, the prescribed final seal pressure is set at a lower level than 1 torr, then the flow step B may be carried out at a pressure of 1 torr. The point is that the flow step B should be taken at a higher pressure than the prescribed final seal pressure.

Unlike the prior art evacuation method in which, prior to the flow step, a fluorescent lamp bulb was preliminarily decompressed to a lower pressure level than that at which the flow step was taken, the evacuation method of this invention causes the atmospheric components remaining in the fluorescent lamp bulb to be forcefully replaced by an inert gas as soon as the flow step is commenced, thereby prominently reducing the operation time. Further with the conventional evacuation method, the fluorescent lamp bulb was decompressed to a lower pressure level than the final seal pressure immediately before the sealing. In contrast, the evacuation method of this invention causes the intrabulb pressure to be immediately reduced from the gas pressure of the flow step to the final seal pressure. In this respect, too, the evacuation method of this invention shortens the operation. Therefore, the invention shortens the overall time of the evacuation operation, thereby, elevating its efficiency.

What we claim is:

1. A method of evacuating a fluorescent lamp bulb comprising:

a first decompression step of decompressing a fluorescent lamp bulb, on the inner wall of which a fluorescent layer is deposited, and both ends of which are provided with an electrode and are are connected to first and second evacuation tubes, to a pressure level higher than a prescribed final seal pressure through the first evacuation tube;

a flow step of, while maintaining the intrabulb pressure at the level attained in the first decompression step, introducing a desired gas into the bulb through the second evacuation tube and expelling the gas through the first evacuation tube to fill the bulb with said gas at said pressure level; and a second decompression step of decreasing the intrabulb pressure from the level attained in the first decompression step to the prescribed final seal pressure.

2. The method according to claim 1, wherein a carbonate of an alkaline earth metal is deposited on the surface of said electrodes and which comprises a flushing step of introducing during the flow step electric current through said electrodes to thermally decompose the carbonate and expelling a by-product of thermal decomposition with a desired gas.

3. The method according to claim 1 or 2, wherein the intrabulb pressure is reduced to a level of 5 to 10 torr in the first decompression step, and to a level of 0.5 to 5 torr in the second decompression step.

* * * * *